US007557777B2

(12) United States Patent
Yu et al.

(10) Patent No.: US 7,557,777 B2
(45) Date of Patent: Jul. 7, 2009

(54) METHOD AND APPARATUS FOR ADJUSTING GAIN FOR EACH POSITION OF PLASMA DISPLAY PANEL

(75) Inventors: Hyun Mok Yu, Ulsan (KR); Soo Seok Sim, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 931 days.

(21) Appl. No.: 10/869,877

(22) Filed: Jun. 18, 2004

(65) Prior Publication Data

US 2004/0257310 A1 Dec. 23, 2004

(30) Foreign Application Priority Data

Jun. 20, 2003 (KR) ..... 10-2003-0040121

(51) Int. Cl.
*G09G 3/28* (2006.01)

(52) U.S. Cl. ..... 345/63; 345/690

(58) Field of Classification Search ..... 345/60, 345/63, 37, 41, 690; 315/169.4; 313/567
See application file for complete search history.

(56) References Cited

U.S. PATENT DOCUMENTS 6,489,938 B1 * 12/2002 Ito ..... 345/63
7,057,585 B2 * 6/2006 Kang et al. ..... 345/60
7,088,313 B2 * 8/2006 Kang ..... 345/60
7,161,607 B2 * 1/2007 Choi ..... 345/690
7,167,146 B2 * 1/2007 Kang ..... 345/68
7,215,316 B2 * 5/2007 Sim et al. ..... 345/101
2002/0175922 A1 * 11/2002 Koo et al. ..... 345/589

FOREIGN PATENT DOCUMENTS

JP 2002-116728 4/2002

OTHER PUBLICATIONS

Korean Office Action Dated Feb. 4, 2005.

* cited by examiner

*Primary Examiner*—Ricardo L Osorio
(74) *Attorney, Agent, or Firm*—KED & Associates, LLP

(57) ABSTRACT

A method and apparatus for adjusting a gain for each position of a plasma display panel for improving a brightness uniformity of a picture field is disclosed. In the method and apparatus, a gain of data to be displayed at a first position of a field of the plasma display panel is controlled into a first gain value. A gain of data to be displayed at a second position of said field is controlled into a second gain value.

8 Claims, 11 Drawing Sheets

METHOD AND APPARATUS FOR ADJUSTING GAIN FOR EACH POSITION OF PLASMA DISPLAY PANEL

This application claims the benefit of Korean Patent Application No. P2003-40121 filed in Korea Jun. 20, 2003, which is hereby incorporated by reference.

BACKGROUND OF THE INVENTION

1. Field of the Invention

This invention relates to a plasma display panel, and more particularly to a method and apparatus for adjusting a gain for each position of a plasma display panel that is adaptive for improving a brightness uniformity of a picture field.

2. Description of the Related Art

Generally, a plasma display panel (PDP) displays a picture by utilizing a visible light emitted from a phosphorus material when an ultraviolet ray generated by a gas discharge excites the phosphorus material. The PDP has advantages in that it has a thinner thickness and a lighter weight in comparison to the existent cathode ray tube (CRT) and is capable of realizing a high resolution and a large-scale screen.

Referring to FIG. 1 and FIG. 2, a conventional three-electrode, AC surface-discharge PDP includes scan electrodes Y1 to Yn and sustain electrodes Z provided on an upper substrate 10, and address electrodes X1 to Xm provided on a lower substrate 18. Discharge cells 1 of the PDP are provided at intersections among the scan electrodes Y1 to Yn, the sustain electrodes Z and the address electrodes X1 to Xm.

Each of the scan electrodes Y1 to Yn and the sustain electrodes Z includes a transparent electrode 12, and a metal bus electrode 11 having a smaller line width than the transparent electrode 12 and provided at one edge of the transparent electrode 12. The transparent electrode 12 is usually formed from indium-tin-oxide (ITO) on the upper substrate 10. The metal bus electrode 11 is usually formed from a metal on the transparent electrode 12 to thereby reduce a voltage drop caused by the transparent electrode 12 having a high resistance. On the upper substrate 10 provided with the scan electrodes Y1 to Yn and the sustain electrodes Z, an upper dielectric layer 13 and a protective film 14 are disposed. Wall charges generated upon plasma discharge are accumulated onto the upper dielectric layer 13. The protective film 14 protects the electrodes Y1 to Yn and Z from a sputtering generated upon plasma discharge, and enhances an emission efficiency of secondary electrons. This protective film 14 is usually made from magnesium oxide (MgO).

The address electrodes X1 to Xm are formed on a lower substrate 18 in a direction crossing the scan electrodes Y1 to Yn and the sustain electrodes. A lower dielectric layer 17 and barrier ribs 15 are formed on the lower substrate 18. A phosphorous material layer 16 is formed on the surfaces of the lower dielectric layer 17 and the barrier ribs 15. The barrier ribs 15 are formed in parallel to the address electrodes X1 to Xm to physically divide the discharge cells 1, thereby shutting off electrical and optical interferences between the adjacent discharge cells 1. The phosphorous material layer 16 is excited and radiated by an ultraviolet ray generated during the plasma discharge to generate any one of red, green and blue visible light rays.

An inactive mixture gas, such as He+Xe, Ne+Xe or He+Ne+Xe, for a discharge is injected into a discharge space defined between the upper/lower substrates 10 and 18 and the barrier ribs 15.

Such a PDP makes a time-divisional driving of one frame, which is divided into various sub-fields having a different light-emission frequency, so as to express gray levels of a picture. Each sub-field is again divided into a reset period for uniformly causing a discharge, an address period for selecting a discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields. Each of the 8 sub-fields is again divided into an address period and a sustain period. Herein, the reset period and the address period of each sub-field are equal every sub-field, whereas the sustain period and the discharge frequency are increased at a ration of $2^n$ (wherein n=0, 1, 2, 3, 4, 5, 6 and 7) at each sub-field in proportion to the number of sustaining pulses. As the sustain period is differentiated at each sub-field as mentioned above, gray levels of a picture can be implemented.

FIG. 3 schematically shows a driving circuit for the PDP.

Referring to FIG. 3, the driving circuit for the PDP includes a gain adjuster 32, an error diffuser 33 and a sub-field mapping unit 34 connected between a first inverse gamma adjuster 31A and a data aligner 35, and an average picture level (APL) calculator 36 connected between a second inverse gamma adjuster 31B and a waveform generator 37.

Each of the first and second inverse gamma adjusters 31A and 31B makes an inverse gamma correction of digital video data RGB from an input line 30 to thereby linearly convert brightness according to gray level values of image signals.

The gain adjuster 32 adjusts an effective gain for each of red, green and blue data to thereby compensate for a color temperature.

The error diffuser 33 diffuses a quantized error of the digital video data RGB inputted from the gain adjuster 32 into the adjacent cells to thereby make a fine control of a brightness value. To this end, the error diffuser 33 divides the data into a positive number part and a decimal fraction part and then multiplies the decimal fraction part by a Floyd-Steinberg coefficient.

The sub-field mapping unit 34 maps a data from the error diffuser 33 onto a sub-field pattern stored in advance for each bit and applies the mapped data to the data aligner 35.

The data aligner 35 applies digital video data inputted from the sub-field mapping unit 34 to a data driving circuit of the PDP 38. The data driving circuit is connected to the data electrodes of the PDP 38 to latch a data from the data aligner 35 for each one horizontal line and then apply the latched data to the data electrodes of the PDP 38 for each one horizontal period.

The APL calculator 36 detects an average brightness per frame of digital video data RGB inputted from the second inverse gamma adjuster 31B, that is, an average picture level (APL), and outputs information about the number of sustaining pulses corresponding to the detected APL.

The waveform generator 37 generates a timing control signal in response to the information about the number of sustaining pulses from the APL calculator 36, and applies the timing control signal to a scan driving circuit and a sustain driving circuit (not shown). The scan driving circuit and the sustain driving circuit apply a sustaining pulse to the scan electrodes and the sustain electrodes of the PDP 38 during the sustain period in response to the timing control signal from the waveform generator 38.

Such a PDP has a larger size, such as 40", 50", 60" or the like, than other flat panel displays (FPDs). Thus, since a length of each electrode X, Y and Z of the PDP is large, a voltage drop caused by the large electrode length emerges on the center field and the peripheral field of the PDP at a relatively large difference. Furthermore, since a discharge gas is injected into the interior of the PDP at a lower pressure than the atmospheric pressure, a force applied to the substrates 10 and 18 at the center field where the upper substrate 10 and the lower substrate 18 are supported only by the barrier ribs 15 becomes different from a force applied to the substrates 10 and 18 at the peripheral field where the upper substrate 10 is joined with the lower substrate 18 by a sealant (not shown). This causes the PDP to have a different size of cell 1 at the center field and the peripheral field although having a difference depending upon of a model and a dimension of the PDP. As a result, although the conventional PDP has somewhat difference depending upon a panel size, brightness at the center field of the PDP becomes approximately 20% lower than brightness at the peripheral field thereof in each of the horizontal direction (or x direction) and the vertical direction (or y direction) as shown in FIG. 4.

Such brightness non-uniformity at the center field and the peripheral field can not be substantially overcome by the circuit shown in FIG. 3. For instance, the driving circuit as shown in FIG. 3 can control red, green and blue data differently for each data, but can not control the data differently for each center field and each peripheral field of the PDP. Therefore, the conventional PDP raises another problem in that, as brightness at the center field is heightened, brightness at the peripheral field also becomes higher, thereby still presenting a brightness difference between the center field and the peripheral field and hence causing higher power consumption.

SUMMARY OF THE INVENTION

Accordingly, it is an object of the present invention to provide a method and apparatus for adjusting a gain for each position of a plasma display panel that is adaptive for improving a brightness uniformity of a picture field.

In order to achieve these and other objects of the invention, a gain adjusting method for each position of a plasma display panel according to an aspect or the present invention includes the steps of setting a gain value differently depending upon a position of a field of the plasma display panel; controlling a gain of data to be displayed at a first position of said field into a first gain value; and controlling a gain of data to be displayed at a second position of said field into a second gain value.

In the gain adjusting method, the first position of said field is within a certain size of center area positioned at the center of said field and at a portion adjacent to the center thereof.

The second position of said field is within the peripheral area of said field other than the center area.

Herein, the first gain value is larger than the second gain value.

A gain adjusting method for each position of a plasma display panel according to another aspect of the present invention includes the steps of assigning a gain value to each of at least two blocks divided from a field of the plasma display panel; and differently controlling a gain of data to be displayed on different blocks, of said blocks, into a gain value assigned for each block.

In the gain adjusting method, said field is divided into M×N blocks (wherein M and N are integers) each of which includes a plurality of pixels.

Said field is divided into a certain size of center block positioned at the center of said field and at a portion adjacent to the center thereof and a peripheral block of said field other than said center area.

Said field is divided into a plurality of pixel rows arranged in a x-axis direction of said field and a plurality of pixel columns arranged in a y-axis direction of said field.

A gain adjusting apparatus for each position of a plasma display panel according to still another aspect of the present invention includes a first gain adjuster for controlling a gain of data to be displayed at a first position of a field of the plasma display panel into a first gain value; and a second gain adjuster for controlling a gain of data to be displayed at a second position of said field into a second gain value.

In the gain adjusting apparatus, the first position of said field is within a certain size of center area positioned at the center of said field and at a portion adjacent to the center thereof.

The second position of said field is within the peripheral area of said field other than the center area.

Herein, the first gain value is larger than the second gain value.

A gain adjusting apparatus for each position of a plasma display panel according to still another aspect of the present invention includes a gain adjuster for differently controlling a gain of data to be displayed on different blocks of a field of the plasma display panel into a gain value assigned for each of at least two blocks divided from said field.

In the gain adjusting apparatus, said field is divided into M×N blocks (wherein M and N are integers) each of which includes a plurality of pixels.

Said field is divided into a certain size of center block positioned at the center of said field and at a portion adjacent to the center thereof and a peripheral block of said field other than said center area.

Said field is divided into a plurality of pixel rows arranged in a x-axis direction of said field and a plurality of pixel columns arranged in a y-axis direction of said field.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
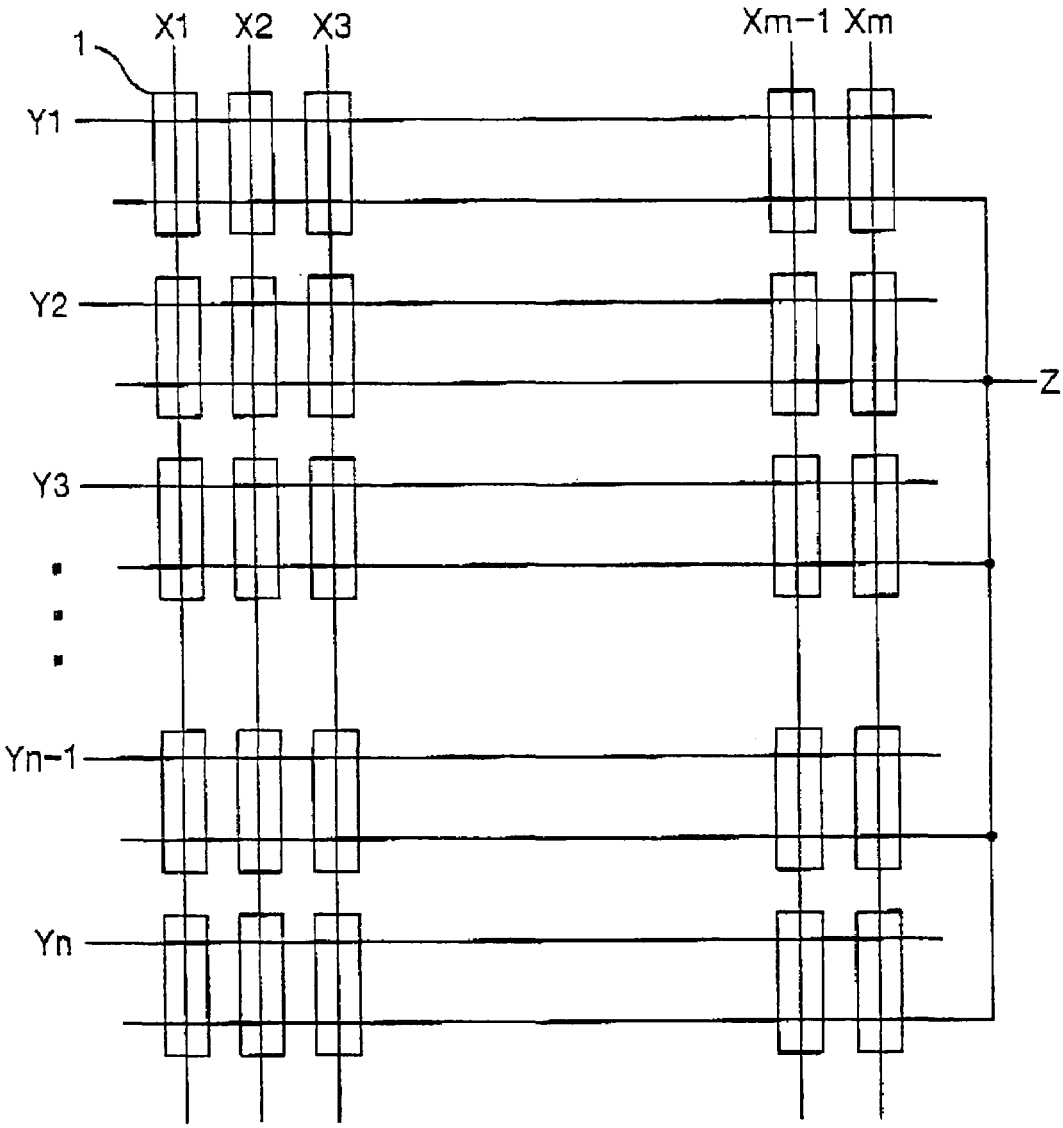
FIG. 1 RELATED ART
FIG. 1 is a schematic plan view showing a configuration of a conventional plasma display panel.
Figure 2:
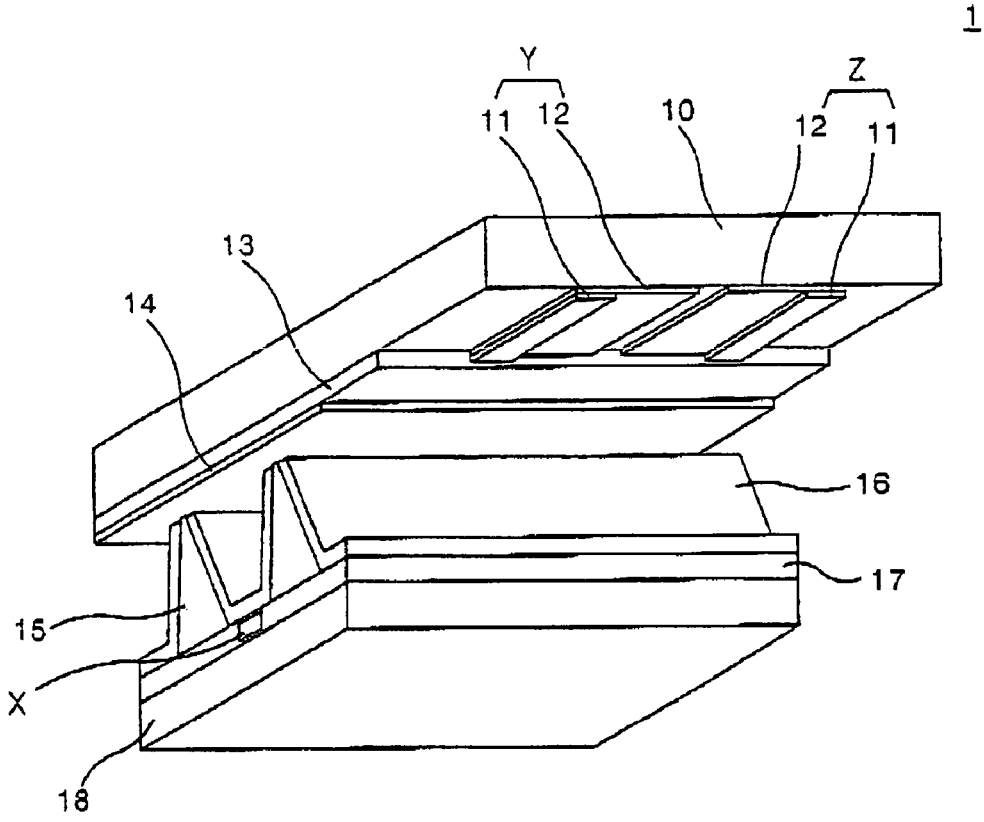
FIG.2 RELATED ART
FIG. 2 is a detailed perspective view showing a structure of the cell shown in FIG. 1.
Figure 3:
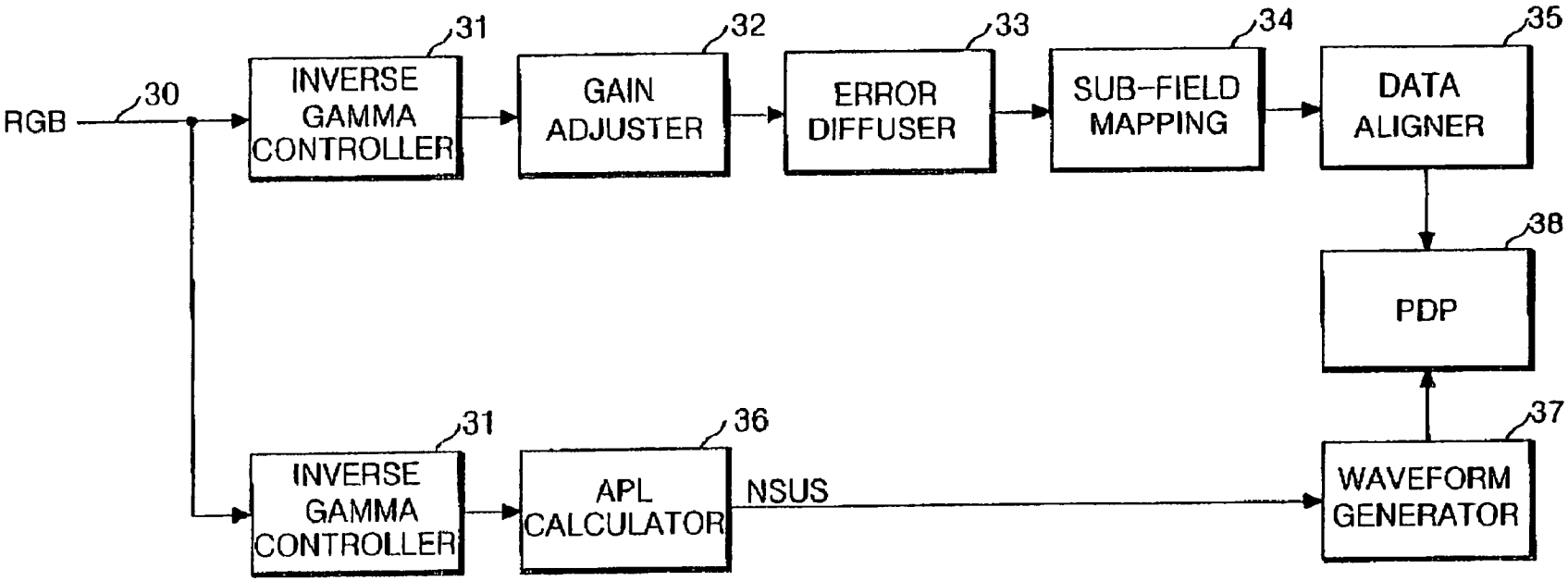
FIG. 3 RELATED ART
FIG. 3 is a block diagram showing a configuration of a driving circuit for the conventional plasma display panel.
Figure 4:
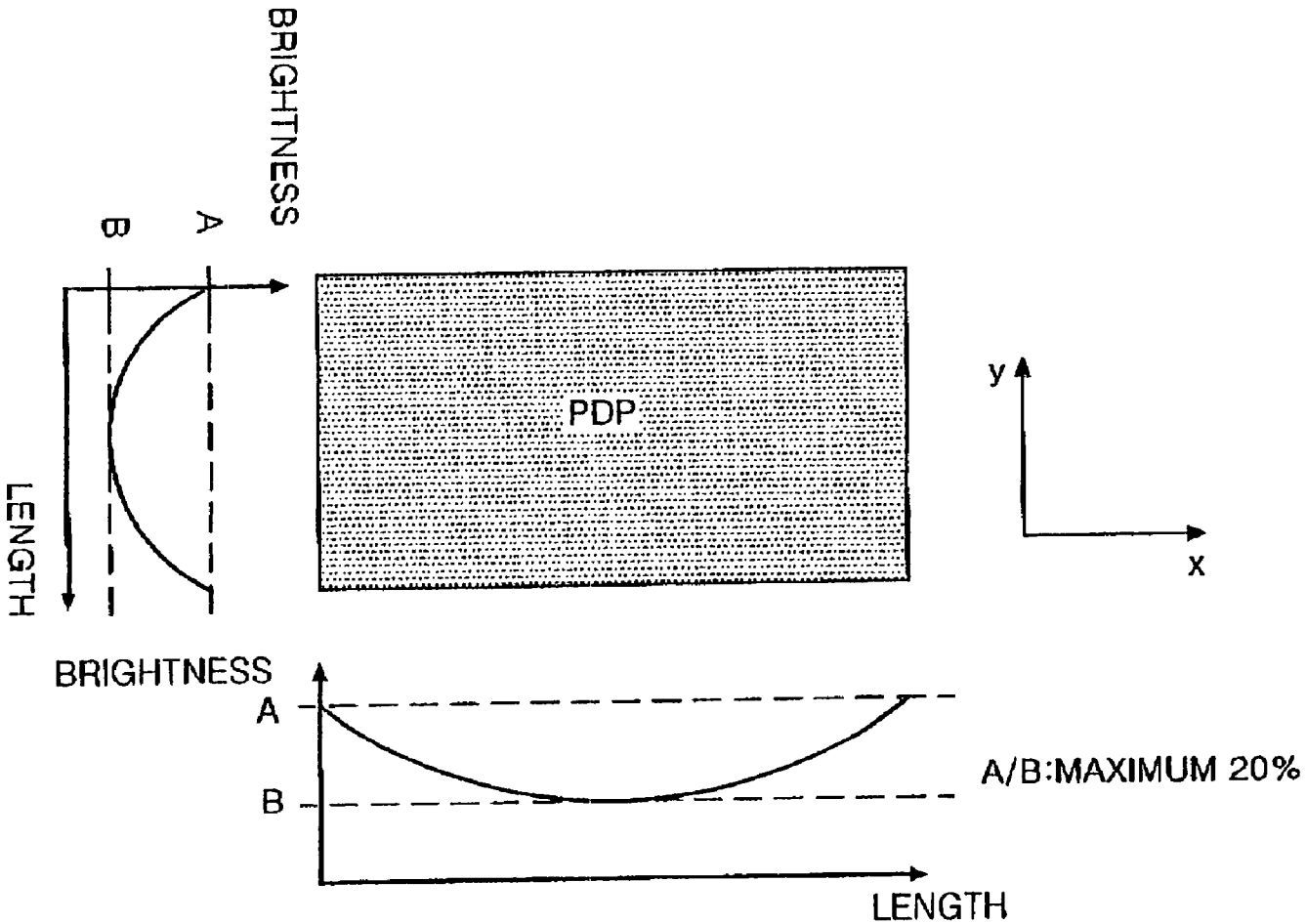
FIG. 4 RELATED ART
FIG. 4 depicts brightness for each position of the plasma display panel.
Figure 5:
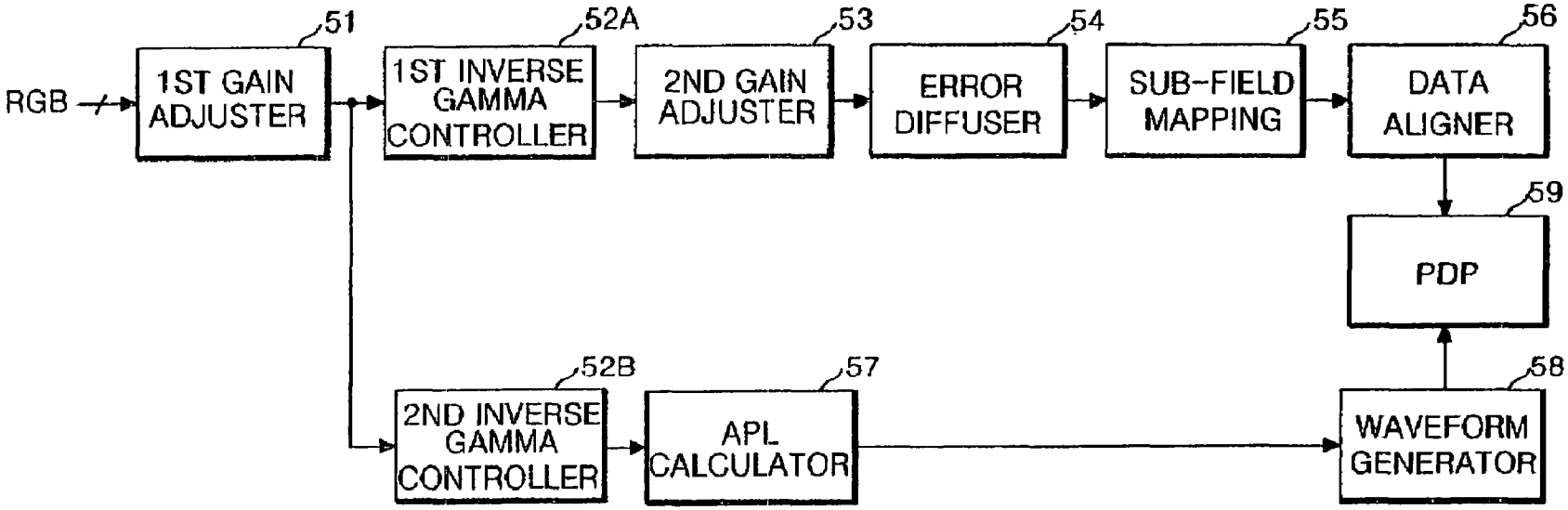
FIG. 5 is a block diagram showing a configuration of a driving circuit for a plasma display panel according to an embodiment of the present invention.

Referring to FIG. 5, a PDP driving apparatus according to an embodiment of the present invention includes a first gain adjuster 51, first and second inverse gamma adjusters 52A and 52B connected to the first gain adjuster 51, a second gain adjuster 53, an error diffuser 54 and a sub-field mapping unit 55 that are connected between the first inverse gamma gain adjuster 52A and a data aligner 56, and an average picture level (APL) calculator 57 connected between the second inverse gamma adjuster 52B and a waveform generator 58.

The first gain adjuster 51 controls a gain of digital video data RGB to be supplied to the peripheral field of the PDP and a gain of digital video data RGB to be supplied to the center field thereof differently depending upon a brightness difference between the peripheral field and the center field of the PDP, thereby compensating for a brightness difference between the peripheral field and the center field of the PDP.

Each of the first and second inverse gamma adjusters 52A and 52B makes an inverse gamma correction of digital video data RGB from the first gain adjuster 51 to thereby linearly convert brightness according to gray level values of image signals.

The second gain adjuster 53 adjusts an effective gain for each of red, green and blue data to thereby compensate for a color temperature.

The error diffuser 54 diffuses a quantized error of the digital video data RGB inputted from the second gain adjuster 53 into the adjacent cells to thereby make a fine control of a brightness value. To this end, the error diffuser 54 divides the data into a positive number part and a decimal fraction part and then multiplies the decimal fraction part by a Floyd-Steinberg coefficient.

The sub-field mapping unit 55 maps a data from the error diffuser 54 onto a sub-field pattern stored in advance for each bit, and applies the mapped data to the data aligner 56.

The data aligner 56 applies digital video data inputted from the sub-field mapping unit 55 to a data driving circuit of the PDP 59. The data driving circuit is connected to the data electrodes of the PDP 59 to latch a data from the data aligner 35 for each one horizontal line and then apply the latched data to the data electrodes of the PDP 59 for each one horizontal period.

The APL calculator 57 detects an average brightness per frame of digital video data RGB inputted from the second inverse gamma adjuster 52B, that is, an average picture level (APL), and outputs information about the number of sustaining pulses corresponding to the detected APL.

The waveform generator 58 generates a timing control signal in response to the information about the number of sustaining pulses from the APL calculator 57, and applies the timing control signal to a scan driving circuit and a sustain driving circuit (not shown). The scan driving circuit and the sustain driving circuit apply a sustaining pulse to the scan electrodes and the sustain electrodes of the PDP 59 during the sustain period in response to the timing control signal from the waveform generator 58.

The gain adjusting apparatus for each position of the PDP according to the embodiment of the present invention uniforms a brightness different at the entire field of the PDP with the aid of the first gain adjuster 51.

Figure 6:
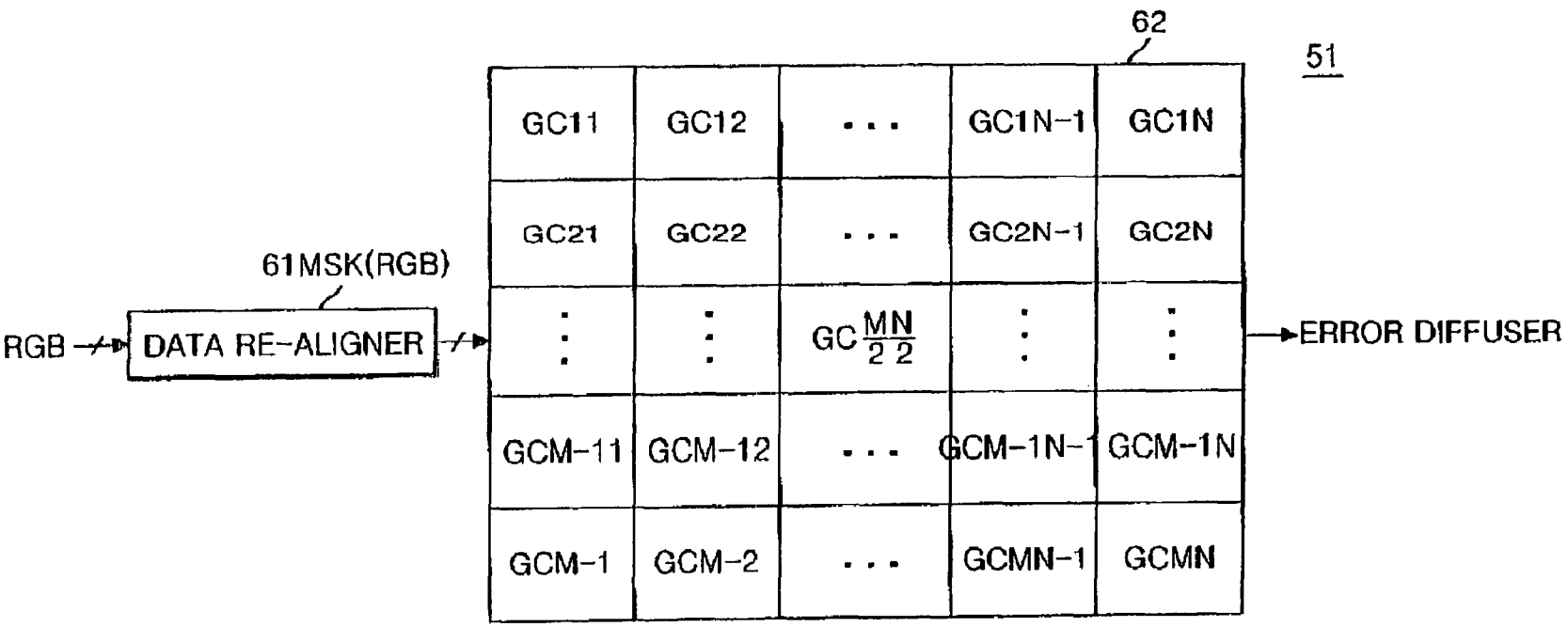
FIG. 6 is a block diagram of a gain adjusting apparatus for each position of a plasma display panel according to a first embodiment of the present invention.

FIG. 6 shows a first embodiment of the first gain adjuster 51.

Referring to FIG. 6, the first gain adjuster 51 according to the first embodiment of the present invention includes a data re-aligner 61 for re-aligning digital video data RGB into predetermined M×N picture blocks, and M×N gain adjusters GC11 to GCMN for adjusting each gain of data MSK(RGB) divided into the M×N picture blocks.

The M×N picture blocks set at the data re-aligner 61 are identical to M×N picture blocks divided from the effective field of the PDP. Each of the picture blocks divided from the effective field of the PDP includes a plurality of pixels. The data re-aligner 61 has a frame memory for storing data, and a multiplexer for dividing the data from the frame memory to each picture block.

The gain adjusters GC11 to GC1N, GC21 to GCM1, GCM2 to GCMN and GCMN at the peripheral picture blocks multiplies data to be supplied to the peripheral field of the PDP by a gain value less than a predetermined reference gain value, thereby relatively lowering a gain of the peripheral field data of the PDP in comparison with the center field data thereof. On the other hand, the gain adjusters $$\left(GC\frac{M}{2}\frac{N}{2}\right)$$

multiplies data to be supplied to the center field of the PDP by a gain value more than the predetermined reference gain value, thereby relatively heightening a gain of the peripheral field data of the PDP in comparison with the center field data.

Figure 7:
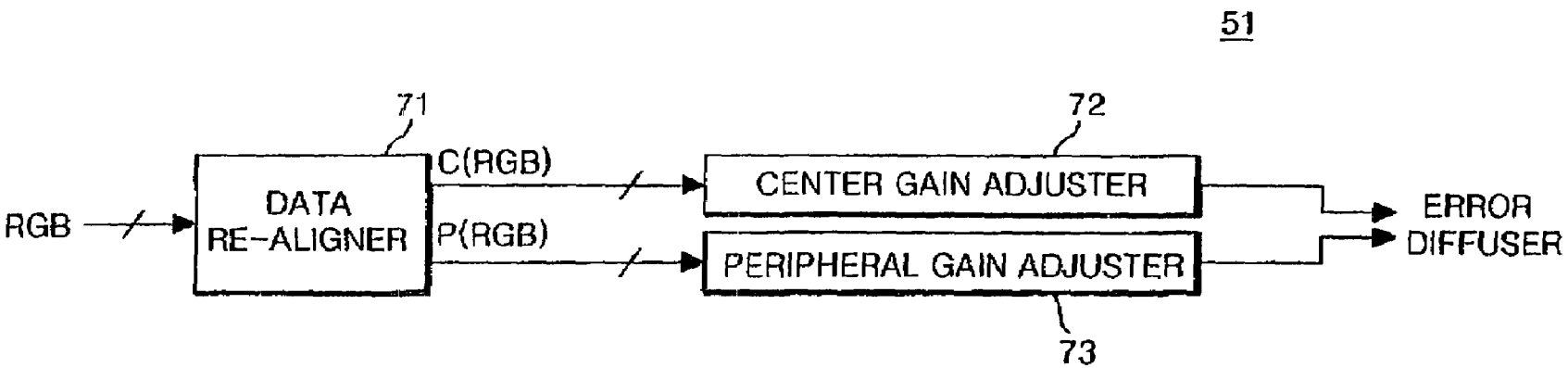
FIG. 7 is a block diagram of a gain adjusting apparatus for each position of a plasma display panel according to a second embodiment of the present invention.

FIG. 7 shows a second embodiment of the first gain adjuster 51.

Referring to FIG. 7, the first gain adjuster 51 according to the second embodiment of the present invention includes a data re-aligner 71 for re-aligning digital video data RGB into a predetermined center picture block and a predetermined peripheral picture block, a center gain adjuster 72 for adjusting a gain of center picture block data C(RGB), and a peripheral gain adjuster 73 for adjusting a gain of peripheral picture block data P(RGB).

Figure 8:
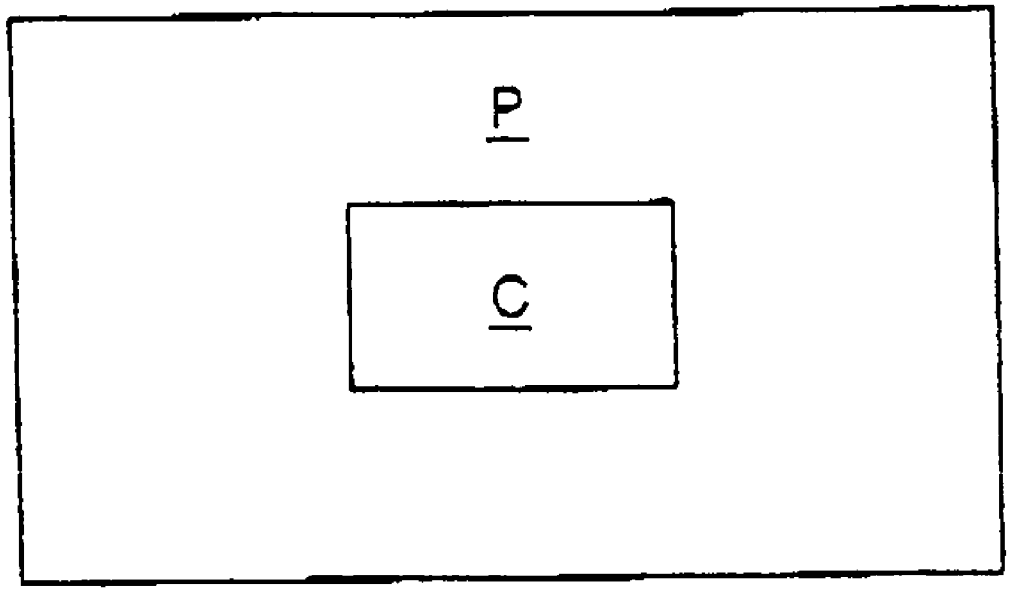
FIG. 8 depicts the center field and the peripheral field of the plasma display panel.

The center picture block and the peripheral picture block set at the data re-aligner 71 are identical to a center picture block C and a peripheral picture block P divided from the effective field of the PDP as shown in FIG. 8. Each of the center picture block C and the peripheral picture block P divided from the effective field of the PDP includes a plurality of pixels, The data re-aligner 71 has a frame memory for storing data, and a multiplexer for dividing the data from the frame memory to the center picture block and the peripheral picture block.

The center gain adjuster 72 multiplies data to be supplied to the center picture block C of the PDP by a gain value more than a predetermined reference gain value, thereby relatively heightening a gain of the center field data of the PDP in comparison with the peripheral field data thereof.

The peripheral gain adjuster 73 multiplies data to be supplied to the peripheral picture block P of the PDP by a gain value less than a predetermined reference gain value, thereby relatively lowering a gain of the peripheral field data of the PDP in comparison with the center field data thereof.

Figure 9:
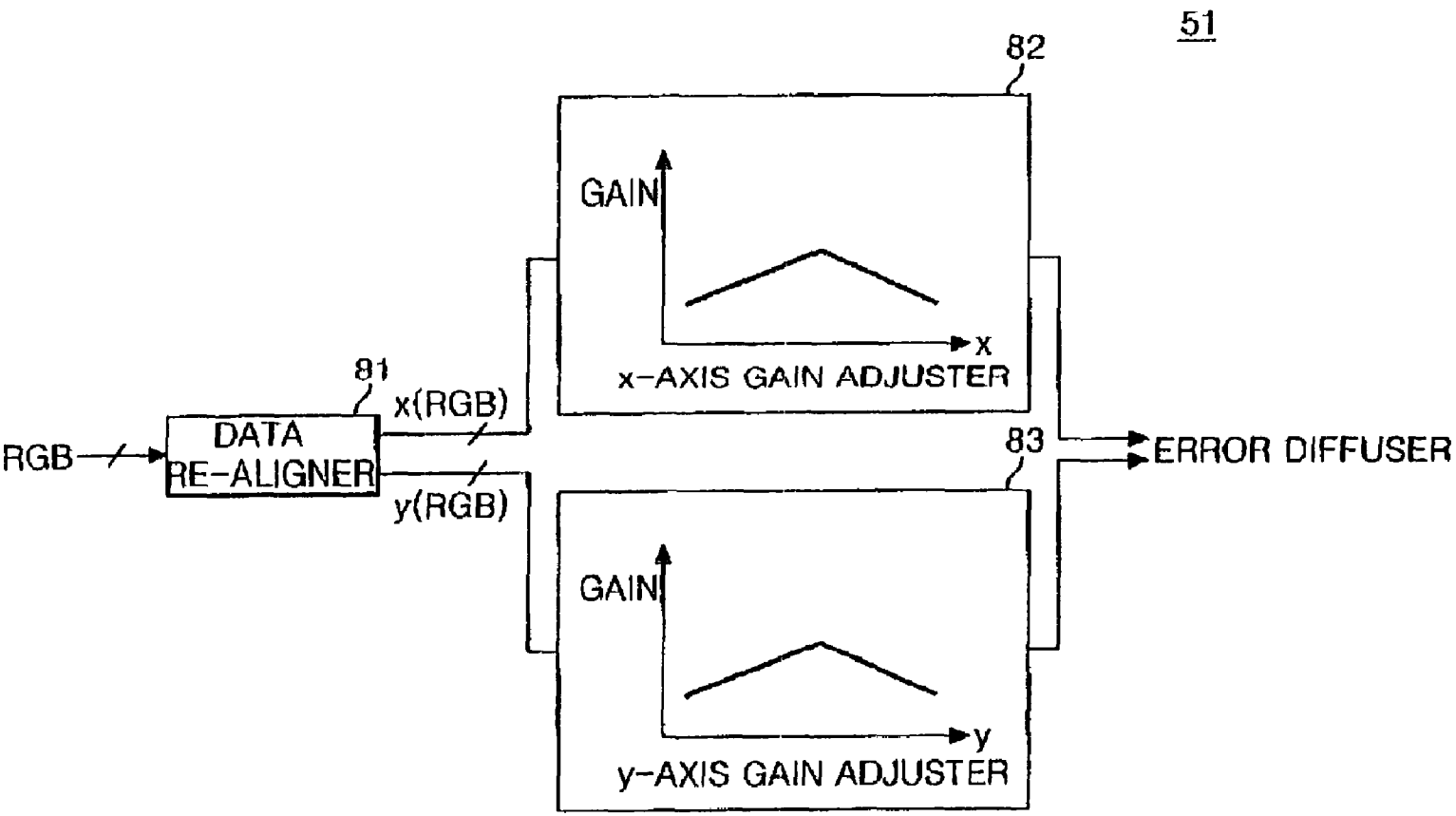
FIG. 9 is a block diagram of a gain adjusting apparatus for each position of a plasma display panel according to a third embodiment of the present invention.

FIG. 9 shows a third embodiment of the first gain adjuster 51.

Referring to FIG. 9, the first gain adjuster 51 according to the third embodiment of the present invention includes a data re-aligner 81 for separating digital video data RGB into predetermined x-axis data x(RGB) and predetermined y-axis data y(RGB), a X-axis gain adjuster 82 for adjusting a gain of x-axis data X(RGB), and a y-axis gain adjuster 83 for adjusting a gain of y-axis data y(RGB).

Figure 10:
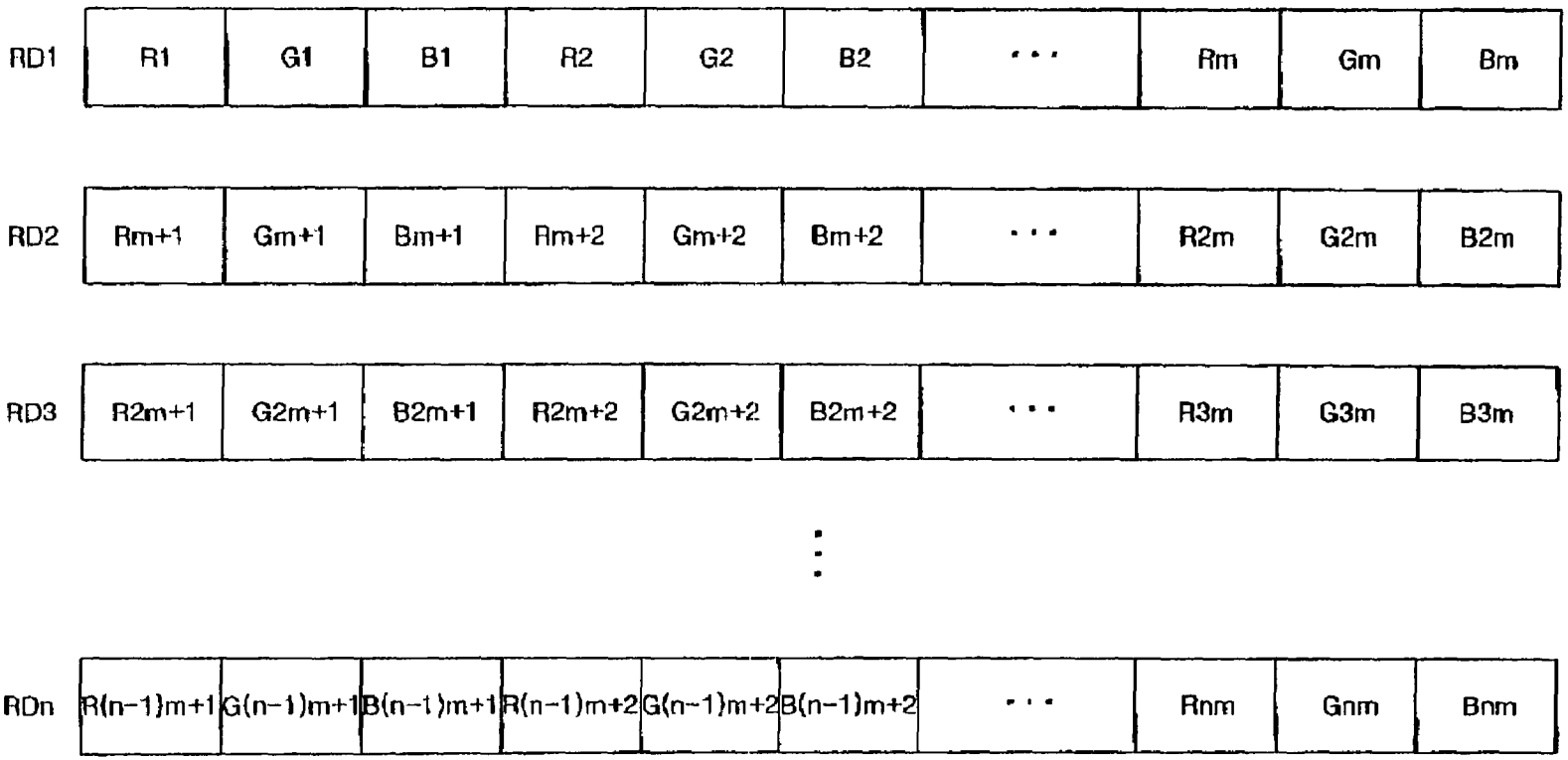
FIG. 10 illustrates a plurality of data rows applied to the plasma display panel.
Figure 11:
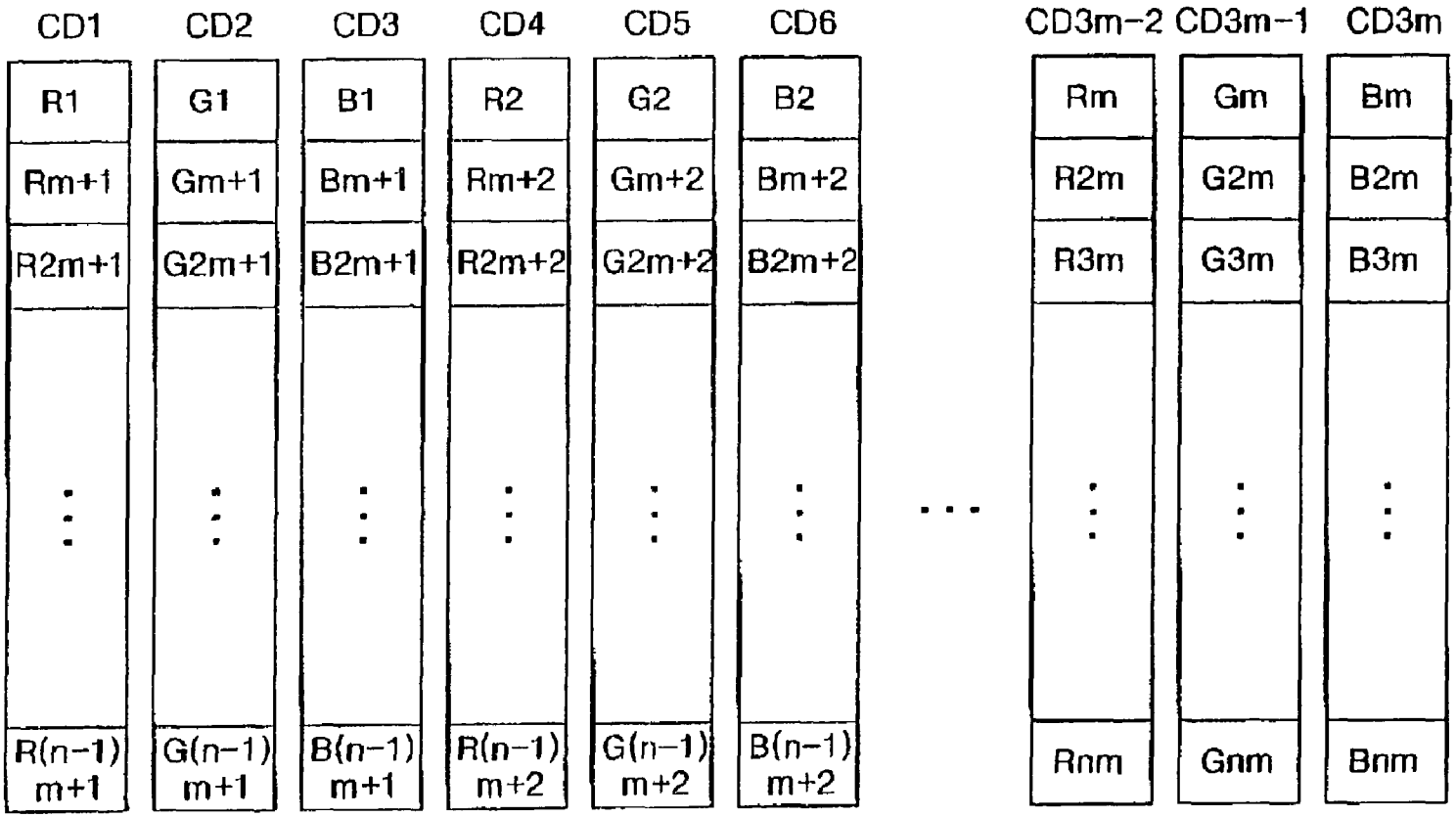
FIG. 11 illustrates a plurality of data columns applied to the plasma display panel.

The data re-aligner 81 applies each row data RD1 to RDn, as shown in FIG. 10, arranged in parallel along the x-axis, of nm pixels of the PDP arranged in a matrix type, to the x-axis gain adjuster 82 while applying each column data CD1 to CD3*m*, as shown in FIG. 11, arranged in parallel along the y-axis to the y-axis gain adjuster 83. The data re-aligner 81 has a frame memory for storing data, and a line memory and a switching device for separating the data from the frame memory into x-axis data x(RGB) and y-axis data y(RGB) to divisionally apply them to the x-axis gain adjuster 82 and the y-axis gain adjuster 83, respectively.

The x-axis gain adjuster 82 multiplies data arranged at the center, of each row data RD1 to RDn as shown in FIG. 10, for example, the first-row center data $$\left(\ldots R\frac{n}{2}, G\frac{n}{2}, B\frac{n}{2} \ldots\right)$$

by a gain value more than a predetermined reference gain value, thereby relatively heightening a gain of each row center data in comparison with each row peripheral data, for example, the first-row peripheral data R1, G1, B1, Rm, Gm and Bm.

The y-axis gain adjuster 83 multiplies data arranged at the center, of each column data CD1 to CD3*m* as shown in FIG. 11, for example, the 3 mth-column center data $$\left(\ldots B\frac{1}{2}nm-1, B\frac{1}{2}nm, B\frac{1}{2}nm+1 \ldots\right)$$

by a gain value more than a predetermined reference gain value, thereby relatively heightening a gain of each column center data in comparison with each column peripheral data, for example, the 3 mth-column peripheral data Bm, B2*m*, B3*m* and Bnm.

As described above, according to the present invention, an effective field of the PDP is divided into M×N block to control a gain of data independently for each block data. Alternatively, according to the present invention, an effective field of the PDP is divided into the center field and the peripheral field to control a gain of data independently for each block data or to control a gain of data independently for each x-axis data and each y-axis data. Accordingly, a gain of data to be supplied to the center field of the PDP is relatively heightened in comparison with that of data to be supplied to the peripheral field thereof, thereby realizing a brightness uniformity of a picture field.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A gain adjusting method for each position of a plasma display panel, comprising:

dividing an input data into a first data to be displayed at a first position of the plasma display panel and a second data to be displayed at a second position of the plasma display panel;

multiplying the first data by a first gain value greater than a reference gain value; and multiplying the second data by a second gain value less than the reference gain value.

2. The gain adjusting method as claimed in claim 1, wherein the first position is within a certain size of a center area positioned at a center of the plasma display panel and at a portion adjacent to the center thereof.

3. The gain adjusting method as claimed in claim 1, wherein the second position of said field is within a peripheral area of the plasma display panel other than a center area.

4. The gain adjusting method as claimed in claim 1, wherein the first gain value is greater than the second gain value.

5. A gain adjusting apparatus for each position of a plasma display panel, comprising:

a data re-aligner dividing an input data into a first data to be displayed at a first position of the plasma display panel and a second data to be displayed at a second position of the plasma display panel;

a first gain adjuster multiplying the first data by a first gain value greater than a reference gain value; and a second gain adjuster multiplying the second data by a second gain value less than the reference gain value.

6. The gain adjusting apparatus as claimed in claim 5, wherein the first position is within a certain size of a center area positioned at a center of the plasma display panel and at a portion adjacent to the center thereof.

7. The gain adjusting apparatus as claimed in claim 6, wherein the second position of said field is within a peripheral area of the plasma display panel other than the center area.

8. The gain adjusting apparatus as claimed in claim 6, wherein the first gain value is greater than the second gain value.

* * * * *